United States Patent [19]

Jackson

[11] 4,396,147

[45] Aug. 2, 1983

[54] CONTAINER CONSTRUCTION

[75] Inventor: William B. Jackson, Canandaigua, N.Y.

[73] Assignee: Mobil Oil Corporation, New York, N.Y.

[21] Appl. No.: 210,501

[22] Filed: Nov. 24, 1980

Related U.S. Application Data

[63] Continuation of Ser. No. 910,933, May 30, 1978, abandoned.

[51] Int. Cl.[3] ..... B65D 5/66

[52] U.S. Cl. ..... 229/44 EC; 206/519

[58] Field of Search ..... 229/2.5 EC, 44 EC, 45 EC; 206/519

[56] References Cited

U.S. PATENT DOCUMENTS 3,094,240 6/1963 Wanderer ..... 206/519

3,670,952 6/1972 Venuti et al. ..... 229/44 EC

*Primary Examiner*—Stephen P. Garbe

*Attorney, Agent, or Firm*—C. A. Huggett; M. G. Gilman; J. P. O'Sullivan, Sr.

[57] ABSTRACT

A container, which is adapted for nesting together with similar containers during transport and storage thereof, comprising an exterior surface which bears printed indicia. The printed indicia is carried on one or more portions of the container that have been formed so that surfaces of such printed portions lie in a plane below the plane of the surrounding surface area. Thermoplastic foam egg cartons such as polystyrene cartons are especially suitable as containers constructed in accord with the invention.

2 Claims, 7 Drawing Figures

CONTAINER CONSTRUCTION

BACKGROUND OF THE INVENTION

1. Reference to Copending Application

This application is a continuation of U.S. patent application Ser. No. 910,933, filed May 30, 1978, now abandoned, for Container Construction.

2. Field of the Invention

The present invention relates to surface printed containers which are nested together in intimate interfacial contact for shipment or storage. In commercial operations such nesting or stacking usually occurs immediately following a printing operation whereby the containers are surface printed with advertising indicia. In many instances the printed surface may still be sticky or not completely dry when a succession of such printed articles are being nested together. Accordingly, when the wet printed surface of an article is scraped or pressed against the surface of an adjacent article in the nested stack, a smearing of the inked indicia occurs, oftentimes completely obliterating the advertiser's message.

Although it is a common problem whenever a plurality of freshly printed articles are to be nested together, it has been found to be particularly troublesome when attempts have been made to print the side wall surfaces of egg carton lids. In the past, only the interior and exterior surfaces of egg carton lids were capable of being printed and thereafter nested together. This was possible due to the cross-sectional configuration of the carton lids which are usually characterized by having outwardly sloping side walls whereby when the lids are nested together their planar top wall surfaces never come into interfacial contact.

When eggs are retailed commercially, it is common practice today to package them in cartons containing 12 eggs and to stack such cartons in refrigerator display cases so that such a stack of cartons has the side wall of the carton lid in view for the consumers. Such a location would be ideal for printed indicia. However, in the past problems have been encountered when attempts have been made to print the carton side wall and stack such printed cartons in a nested arrangement while the ink on the carton side wall has not completely dried. Attempts to remedy this have included the employment of expensive ultraviolet-curable inks containing a photoinitiator which upon exposure to ultraviolet light cures and dries instantly. In addition to the expense involved when such inks are used, they provide potential hazards in handling, since they are catalyzed inks to which printing personnel can develop skin sensitivity. Additionally the ultraviolet radiation must be very carefully controlled to prevent any damage and skin burns. It has also been found that when such inks are employed on a flat surface, which comes into contact with another flat surface, there is a tendency for abrasion of the ink surface and obliteration of the printed indicia.

Applicant has found that when flat recessed panel areas are formed in the carton side walls, such recessed areas may be printed using relatively inexpensive oil or glycol based inks which, although they may not dry completely during the stacking operation at high production line speeds, since the printed area is recessed, such printed areas never come into contact with an adjacent lid side wall when the cartons are nested together in stacked alignment.

In accordance with one aspect of the specific invention, such recessed panels may be formed in the lid side walls of polystyrene foam egg cartons during the matched mold thermoforming operation employed to form the cartons. The lid forming mold has incorporated therein raised portions in the female cover cavity which, through the correct use of pressure and temperature during the forming operation, compress the lid side wall foam material in pre-selected locations below the plane of the rest of the side wall. The interior side walls of the carton lid opposite the recessed areas remain unchanged whereby the interior egg retaining space is not sacrificed.

It is particularly desirable that the recessed areas on the carton cover side wall be completely surrounded by raised surface areas to insure that the inked indicia of the recessed area on the outside of the carton cover side wall is completely out of contact with the inside surface of the adjacent carton cover side wall when the cartons are stacked or nested together.

In the event that the recessed areas on the carton cover side walls are not completely surrounded on all sides by raised surface areas, care must be taken to insure that such recessed panels are configured to insure that an adjacent carton in a stack will not come into surface contact with the inked indicia.

DESCRIPTION OF THE SPECIFIC EMBODIMENTS

Figure 1:
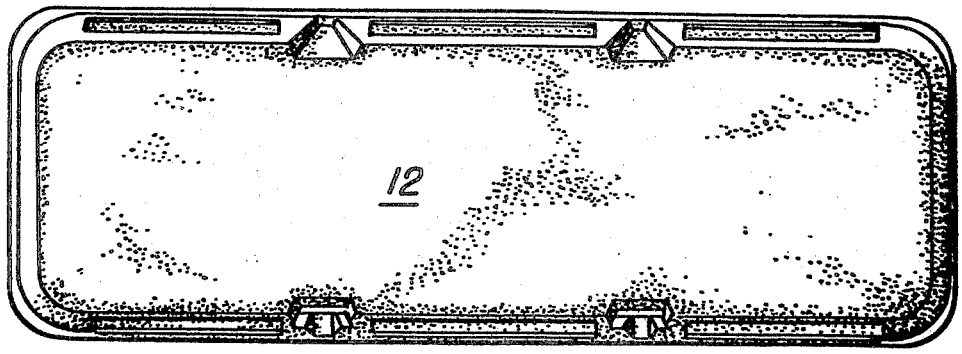
FIG. 1 is an overhead planar view of the carton structure of the present invention.
Figure 2:
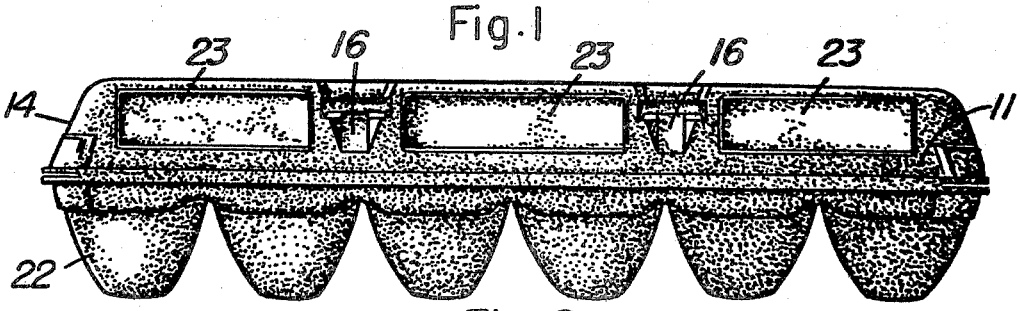
FIG. 2 is a front side elevation view of the carton shown in FIG. 1.
Figure 3:
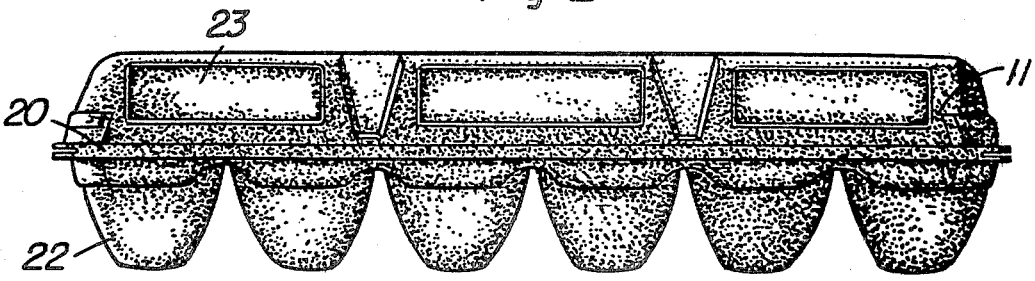
FIG. 3 is a rear side elevation view of the carton shown in FIG. 1.
Figure 4:
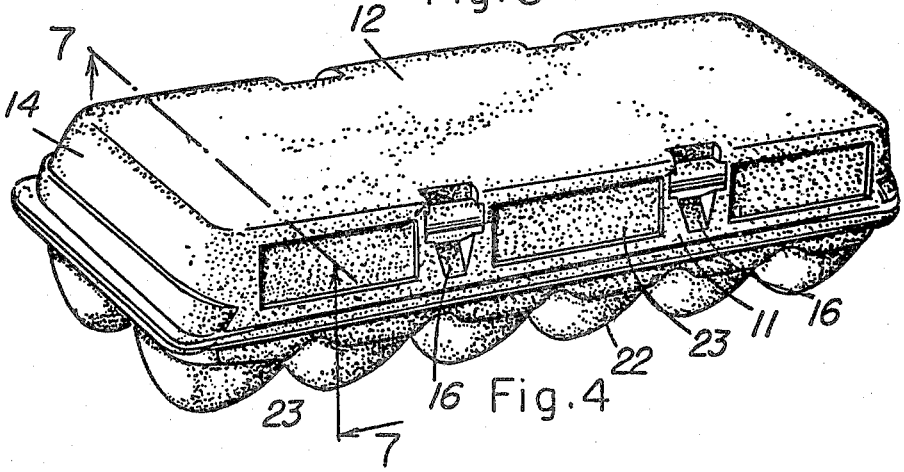
FIG. 4 is a perspective view of the carton shown in FIGS. 1, 2 and 3.
Figure 5:
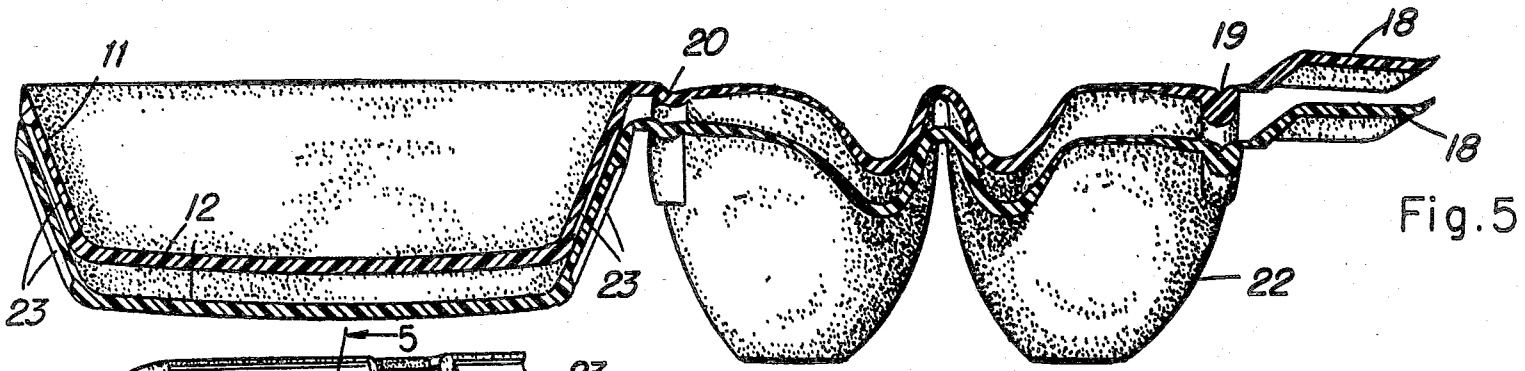
FIG. 5 is a cross-section view of the carton shown in FIGS. 1 through 4 taken on line 5—5 of FIG. 6.
Figure 6:
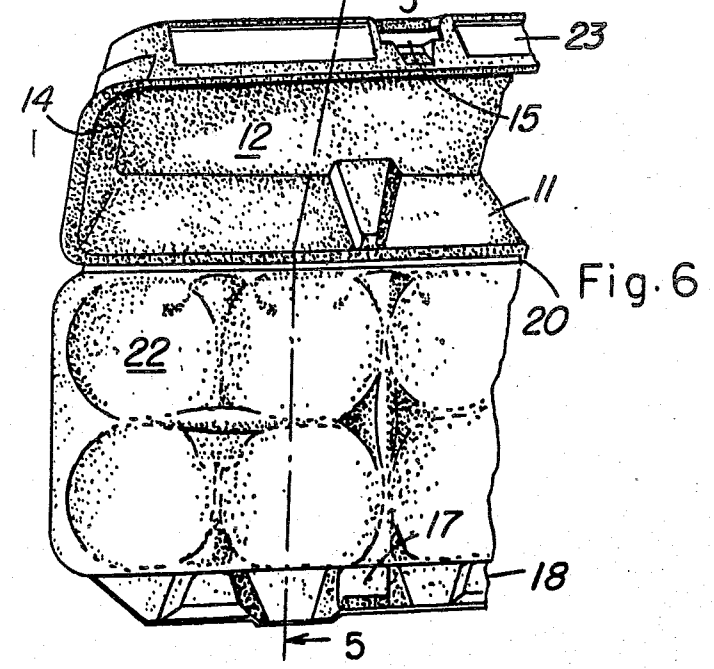
FIG. 6 is a fragmentary perspective view of the present carton structure in a partially open position.
Figure 7:
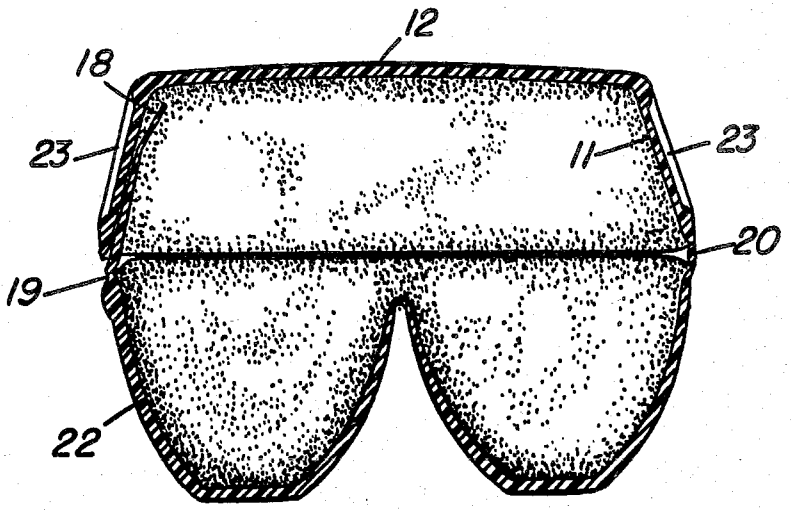
FIG. 7 is a cross-sectional view of the present carton structure taken on line 7—7 of FIG. 4.

As shown in the accompanying drawings, the carton structure of the present invention comprises a cover section and a bottom cellular section. The cover section comprises a generally planar top surface wall 12 having opposite end walls 14 and longitudinally extending front and back walls 11. The cover section is hinged along hinge line 20 to the bottom cellular section. The bottom carton section comprises a plurality of egg receiving cells 22 arranged in two rows of six cells each. A carton locking flap 18 is hinged along hinge line 19 to the upper front edge of the carton cellular section, as shown in FIGS. 5 and 6 of the accompanying drawngs. Locking flap 18 serves to maintain the carton bottom cellular section and top section in a locked position when the carton is closed. To close and lock the carton structure locking flap 18 is placed in a vertical position so that when the cover section is rotated around hinge 20 to a closed position, locking flap 18 will assume a position on the interior surface of front side wall 11.

Detents 16 which are located in spaced apart positions on front side wall 11 of the cover section engage the top portion of recess 17 to secure the carton in a locked position. When it is desired to open the carton the recesses 17 are pushed back out of contact with detents 16 by inserting thumb between flap 18 and cover front wall 11. For a more complete description of the operation of the carton's locking mechanism attention is directed to U.S. Pat. No. 3,648,916 the disclosure of which is incorporated herein by reference.

As shown in the drawings, front and rear walls 11 on the carton cover section are provided with recessed panels 23 which are positioned in spaced apart locations on the carton. Although a plurality of recessed panels 23 are shown in the specific embodiment set forth in the drawings, it will be understood that this is solely for purposes of illustration and that as few as only a single recessed panel may be employed. The panels 23 may be inset from the outer plane of the carton cover side walls 11 a distance of from about 15 to about 55 mils and preferably from about 30 to about 40 mils. As more clearly shown in FIG. 5, when a plurality of the carton structures of the present invention are arranged in a nested position as hereinbefore discussed, the flat recessed panels 23 will be maintained out of contact with corresponding panels 23 of an adjacent carton by virtue of the raised plane area of that portion of the carton cover side walls which surround recessed panels 23. This arrangement has been found to be an effective method of preventing the inked indicia printed on the surface of panels 23 from being smeared or obliterated by the inside front wall surfaces of adjacent cartons.

Although the preferred material of construction for the egg carton embodiment of the structure of the present invention is a foamed thermoplastic such as polystyrene foam, other materials may be employed such as molded pulp or unfoamed plastic materials including polystyrene, polyvinylchloride, polyolefins and the like.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. In a nestable egg carton structure formed from thermoplastic foam comprising a bottom cellular section and an inverted dish-like cover section hinged thereto along a common side edge, said cover comprising a relatively planar top wall, two longitudinally extending side wall members depending downwardly and outwardly from said top wall and two end walls located, and depending downwardly from, opposite ends of said top wall, the improvement which comprises at least one flat, recessed, panel area located on the outer surface of at least one cover side wall, said recessed area bearing printed indicia on the surface thereof, and wherein said recessed area comprises a substantially flat portion of reduced thickness relative to the surrounding area, so that said recessed area is at least substantially surrounded by raised surface areas to keep said printed indicia completely out of contact with the inside surface of an adjacent cover side wall during carton nesting, the inside surface of the carton lid wall opposite the recessed area is in the plane of the remainder of the surface of said wall.

2. A nestable egg carton according to claim 1, where said thermoplastic foam is polystyrene.

* * * * *